US008262457B2

(12) United States Patent
Ansari et al.

(10) Patent No.: US 8,262,457 B2
(45) Date of Patent: Sep. 11, 2012

(54) WAGERING GAME APPARATUS AND METHOD TO PROVIDE A TRUSTED GAMING ENVIRONMENT

(75) Inventors: Marwan Ansari, Plainfield, IL (US); Allon G. Englman, Chicago, IL (US); Philip B. Gelber, Glen Ellyn, IL (US); Joel R. Jaffe, Glenview, IL (US); Ryan R. Summers, Elk Grove Village, IL (US); Jamie Vann, Chicago, IL (US); John Walsh, Gurnee, IL (US)

(73) Assignee: WMS Gaming Inc., Waukegan, IL (US)

( * ) Notice: Subject to any disclaimer, the term of this patent is extended or adjusted under 35 U.S.C. 154(b) by 157 days.

(21) Appl. No.: 12/740,330

(22) PCT Filed: Oct. 31, 2008

(86) PCT No.: PCT/US2008/081995

§ 371 (c)(1), (2), (4) Date: Apr. 28, 2010

(87) PCT Pub. No.: WO2009/059138

PCT Pub. Date: May 7, 2009

(65) Prior Publication Data

US 2010/0298049 A1 Nov. 25, 2010

Related U.S. Application Data

(60) Provisional application No. 61/001,335, filed on Nov. 1, 2007.

(51) Int. Cl.
*A63F 9/24* (2006.01)

(52) U.S. Cl. ..... 463/20; 463/16; 463/25

(58) Field of Classification Search ..... 463/16, 463/20, 25

See application file for complete search history.

(56) References Cited

U.S. PATENT DOCUMENTS

| | | | | |
|---|---|---|---|---|
| 4,306,768 | A | 12/1981 | Egging | 350/174 |
| 4,448,419 | A | 5/1984 | Telnaes | 463/21 |
| 4,454,670 | A | 6/1984 | Bachmann et al. | 194/350 |
| 4,517,558 | A | 5/1985 | Davids | 340/700 |
| 4,568,928 | A | 2/1986 | Biferno | 340/716 |
| 4,718,672 | A | 1/1988 | Okada | 273/143 R |
| 4,875,144 | A | 10/1989 | Wainwright | 362/103 |
| 5,152,529 | A | 10/1992 | Okada | 273/143 R |

(Continued)

FOREIGN PATENT DOCUMENTS

EP 0 060 019 A1 9/1982

(Continued)

OTHER PUBLICATIONS

"Bigfoot" Product Sheet, Shuffle Master, Inc., 1 page (2000).

(Continued)

*Primary Examiner* — Omkar Deodhar
(74) *Attorney, Agent, or Firm* — Nixon Peabody LLP

(57) ABSTRACT

A method of configuring a wagering game system to provide a trusted gaming environment includes the acts of randomly selecting at least one simulated physical imperfection from a plurality of available simulated physical imperfections to associate with at least one element of a video image output to a wagering game machine video display and associating the selected simulated physical imperfection with at least one element of the video image.

25 Claims, 7 Drawing Sheets

U.S. PATENT DOCUMENTS

| | | | | |
|---|---|---|---|---|
| 5,283,560 | A | 2/1994 | Bartlett | 715/729 |
| 5,283,673 | A | 2/1994 | Murase et al. | 359/49 |
| 5,351,966 | A | 10/1994 | Tohyama et al. | 463/2 |
| 5,375,043 | A | 12/1994 | Tokunanga | 362/31 |
| 5,393,061 | A | 2/1995 | Manship et al. | 273/143 R |
| RE35,188 | E | 3/1996 | Howard | |
| 5,580,055 | A | 12/1996 | Hagiwara | 273/143 R |
| 5,697,843 | A | 12/1997 | Manship et al. | 463/20 |
| 5,722,891 | A | 3/1998 | Inoue | 463/20 |
| 5,725,210 | A | 3/1998 | Yamaguchi et al. | 273/121 |
| 5,752,881 | A | 5/1998 | Inoue | 273/143 R |
| 5,810,665 | A | 9/1998 | Takemoto et al. | 463/31 |
| 5,873,645 | A | 2/1999 | Belfer | 362/551 |
| 5,890,962 | A | 4/1999 | Takemoto | 463/20 |
| 5,934,672 | A | 8/1999 | Sines et al. | 273/143 R |
| 5,980,384 | A | 11/1999 | Barrie | 463/16 |
| 6,027,115 | A | 2/2000 | Griswald et al. | 273/143 R |
| 6,036,188 | A | 3/2000 | Gomez et al. | 273/118 R |
| 6,038,188 | A | 3/2000 | Akamatsu | 365/226 |
| 6,056,642 | A | 5/2000 | Bennett | 463/20 |
| 6,068,552 | A | 5/2000 | Walker et al. | 463/21 |
| 6,086,066 | A | 7/2000 | Takeuchi et al. | 273/143 R |
| 6,089,977 | A | 7/2000 | Bennett | 463/20 |
| 6,095,921 | A | 8/2000 | Walker et al. | 463/20 |
| 6,135,884 | A | 10/2000 | Hedrick et al. | 463/20 |
| 6,135,885 | A | 10/2000 | Lermusiaux | 463/20 |
| 6,164,645 | A | 12/2000 | Weiss | 273/138.2 |
| 6,181,301 | B1 | 1/2001 | Inoguchi et al. | 345/5 |
| 6,193,606 | B1 | 2/2001 | Walker et al. | 463/20 |
| 6,224,482 | B1 | 5/2001 | Bennett | 463/20 |
| 6,251,013 | B1 | 6/2001 | Bennett | 463/13 |
| 6,261,177 | B1 | 7/2001 | Bennett | 463/16 |
| 6,270,411 | B1 | 8/2001 | Gura et al. | 463/20 |
| 6,290,600 | B1 | 9/2001 | Glasson | 463/20 |
| 6,311,974 | B1 | 11/2001 | Koga | 273/118 |
| 6,348,905 | B1 | 2/2002 | Wang | |
| 6,364,766 | B1 | 4/2002 | Anderson et al. | 463/16 |
| 6,368,216 | B1 | 4/2002 | Hedrick et al. | 463/20 |
| 6,375,568 | B1 | 4/2002 | Roffman et al. | 463/26 |
| 6,408,429 | B1 | 6/2002 | Marrion et al. | |
| 6,409,170 | B1 | 6/2002 | Sugimoto | 273/143 |
| 6,419,579 | B1 | 7/2002 | Bennett | 463/20 |
| 6,443,586 | B1 | 9/2002 | Azima et al. | 362/86 |
| 6,471,387 | B1 | 10/2002 | Henshaw et al. | 362/555 |
| 6,497,617 | B1 | 12/2002 | Yoshida | 463/20 |
| 6,517,432 | B1 | 2/2003 | Jaffe | 463/16 |
| 6,517,433 | B2 | 2/2003 | Loose et al. | 463/20 |
| 6,592,238 | B2 | 7/2003 | Cleaver et al. | 362/249 |
| 6,690,819 | B1 | 2/2004 | Teraji | |
| 6,742,776 | B2 | 6/2004 | Monsoon et al. | 267/136 |
| 6,817,946 | B2 | 11/2004 | Motegi et al. | 463/31 |
| 6,837,790 | B1 | 1/2005 | Kaminkow | |
| 6,937,298 | B2 | 8/2005 | Okada | 349/58 |
| 7,097,560 | B2 | 8/2006 | Okada | 463/20 |
| 7,140,963 | B2 | 11/2006 | Kojima | 463/20 |
| 7,159,865 | B2 | 1/2007 | Okada | 273/143 |
| 7,160,187 | B2 | 1/2007 | Loose et al. | 463/20 |
| 7,166,029 | B2 | 1/2007 | Enzminger | 463/20 |
| 7,170,647 | B2 | 1/2007 | Kanatsu | |
| 7,204,753 | B2 | 4/2007 | Ozaki et al. | 463/16 |
| 7,255,643 | B2 | 8/2007 | Ozaki et al. | 463/20 |
| 7,274,813 | B2 | 9/2007 | Maeda et al. | |
| 7,302,091 | B2 | 11/2007 | Hamaguchi et al. | |
| 7,452,276 | B2 | 11/2008 | Loose et al. | |
| 7,654,899 | B2 | 2/2010 | Durham et al. | |
| 7,841,944 | B2 | 11/2010 | Wells | |
| 7,942,745 | B2 | 5/2011 | Ikeda et al. | |
| 2001/0000636 | A1 | 5/2001 | Weiss | 273/138.2 |
| 2001/0031658 | A1 | 10/2001 | Ozaki et al. | 463/16 |
| 2002/0173354 | A1 | 11/2002 | Winas et al. | 463/20 |
| 2002/0175466 | A1 | 11/2002 | Loose et al. | 273/143 |
| 2003/0032479 | A1 | 2/2003 | LeMay et al. | |
| 2003/0060269 | A1 | 3/2003 | Paulsen et al. | 463/20 |
| 2003/0064814 | A1 | 4/2003 | Stephen et al. | 463/46 |
| 2003/0087690 | A1 | 5/2003 | Loose et al. | 463/20 |
| 2003/0119577 | A1 | 6/2003 | Motegi et al. | 463/20 |
| 2003/0144051 | A1 | 7/2003 | Gauselmann | |
| 2003/0157980 | A1 | 8/2003 | Loose et al. | |
| 2003/0171149 | A1* | 9/2003 | Rothschild | 463/42 |
| 2003/0234489 | A1 | 12/2003 | Okada | 273/236 |
| 2003/0236118 | A1 | 12/2003 | Okada | 463/20 |
| 2004/0014520 | A1 | 1/2004 | Okada | 463/20 |
| 2004/0029636 | A1 | 2/2004 | Wells | 463/32 |
| 2004/0053663 | A1 | 3/2004 | Paulsen et al. | 463/16 |
| 2004/0053685 | A1 | 3/2004 | Seelig et al. | 463/25 |
| 2004/0063490 | A1 | 4/2004 | Okada | 463/20 |
| 2004/0082384 | A1 | 4/2004 | Walker et al. | |
| 2004/0102241 | A1 | 5/2004 | Kaminkow | |
| 2004/0116178 | A1 | 6/2004 | Okada | 463/20 |
| 2004/0147303 | A1 | 7/2004 | Imura et al. | 463/16 |
| 2004/0150162 | A1 | 8/2004 | Okada | 273/292 |
| 2004/0152502 | A1 | 8/2004 | Okada | 463/16 |
| 2004/0166925 | A1 | 8/2004 | Emori et al. | 463/20 |
| 2004/0166926 | A1 | 8/2004 | Adachi et al. | 463/20 |
| 2004/0171418 | A1 | 9/2004 | Okada | 463/20 |
| 2004/0192430 | A1 | 9/2004 | Burak et al. | 463/20 |
| 2004/0198485 | A1 | 10/2004 | Loose et al. | 463/20 |
| 2004/0207154 | A1 | 10/2004 | Okada | 273/138.1 |
| 2004/0209666 | A1 | 10/2004 | Tashiro et al. | 463/20 |
| 2004/0209667 | A1 | 10/2004 | Emori et al. | 463/20 |
| 2004/0209668 | A1 | 10/2004 | Okada | 463/20 |
| 2004/0209670 | A1 | 10/2004 | Adachi et al. | 463/20 |
| 2004/0209671 | A1 | 10/2004 | Okada | 463/20 |
| 2004/0209672 | A1 | 10/2004 | Okada | 463/20 |
| 2004/0209678 | A1 | 10/2004 | Okada | 463/30 |
| 2004/0209681 | A1 | 10/2004 | Emori et al. | 463/31 |
| 2004/0209682 | A1 | 10/2004 | Okada | 463/31 |
| 2004/0214635 | A1 | 10/2004 | Okada | 463/30 |
| 2004/0214637 | A1 | 10/2004 | Nonaka | 463/31 |
| 2004/0219965 | A1 | 11/2004 | Okada | 463/16 |
| 2004/0224747 | A1 | 11/2004 | Okada | 463/16 |
| 2004/0224758 | A1 | 11/2004 | Okada et al. | 463/31 |
| 2004/0227286 | A1 | 11/2004 | Tanimura et al. | 273/143 |
| 2004/0227866 | A1 | 11/2004 | Okada | 349/58 |
| 2004/0229680 | A1 | 11/2004 | Hoshino et al. | 463/20 |
| 2004/0229686 | A1 | 11/2004 | Tanimura et al. | 463/30 |
| 2004/0266510 | A1 | 12/2004 | Kojima | 463/16 |
| 2004/0266515 | A1 | 12/2004 | Gauselmann | 463/20 |
| 2004/0266521 | A1 | 12/2004 | Kojima | 463/20 |
| 2005/0032571 | A1 | 2/2005 | Asonuma | 463/20 |
| 2005/0037843 | A1 | 2/2005 | Wells et al. | |
| 2005/0140088 | A1 | 6/2005 | Randall | 273/143 R |
| 2005/0153775 | A1 | 7/2005 | Griswold et al. | 463/30 |
| 2005/0153780 | A1 | 7/2005 | Gauselmann | 463/47 |
| 2005/0187003 | A1 | 8/2005 | Adachi et al. | 463/16 |
| 2005/0192090 | A1 | 9/2005 | Muir et al. | 463/30 |
| 2005/0233799 | A1 | 10/2005 | LeMay et al. | |
| 2005/0255908 | A1 | 11/2005 | Wells | 463/20 |
| 2005/0272500 | A1 | 12/2005 | Tanimura et al. | 463/20 |
| 2005/0282616 | A1 | 12/2005 | Tanimura et al. | 463/20 |
| 2005/0282617 | A1 | 12/2005 | Sekiguchi et al. | 463/20 |
| 2006/0014580 | A1 | 1/2006 | Hawthorn | 463/20 |
| 2006/0058100 | A1 | 3/2006 | Pacey et al. | |
| 2006/0100013 | A1 | 5/2006 | Enzminger | 463/30 |
| 2006/0135248 | A1 | 6/2006 | Anderson et al. | 463/22 |
| 2006/0199638 | A1 | 9/2006 | Walker et al. | |
| 2006/0247041 | A1 | 11/2006 | Walker et al. | |
| 2006/0252496 | A1 | 11/2006 | Rasmussen | 463/20 |
| 2006/0281530 | A1 | 12/2006 | Seelig et al. | 463/20 |
| 2007/0004513 | A1 | 1/2007 | Wells et al. | 463/31 |
| 2007/0010318 | A1 | 1/2007 | Rigsby et al. | 463/20 |
| 2007/0054730 | A1 | 3/2007 | Mattice et al. | 463/16 |
| 2007/0077986 | A1 | 4/2007 | Loose et al. | 463/20 |
| 2007/0149281 | A1 | 6/2007 | Gadda et al. | 463/34 |
| 2007/0228651 | A1 | 10/2007 | Loose et al. | 463/16 |
| 2008/0004104 | A1 | 1/2008 | Durham et al. | 463/20 |
| 2008/0039199 | A1 | 2/2008 | Baer et al. | |
| 2008/0108422 | A1 | 5/2008 | Hedrick et al. | 463/22 |
| 2008/0113745 | A1 | 5/2008 | Williams et al. | 463/20 |
| 2008/0113746 | A1 | 5/2008 | Williams et al. | 463/20 |
| 2008/0113747 | A1 | 5/2008 | Williams et al. | 463/20 |
| 2008/0113748 | A1* | 5/2008 | Williams et al. | 463/20 |
| 2008/0113749 | A1 | 5/2008 | Williams et al. | 463/20 |
| 2008/0113755 | A1 | 5/2008 | Rasmussen et al. | |
| 2009/0075721 | A1 | 3/2009 | Pacey et al. | |

| | | | | |
|---|---|---|---|---|
| 2009/0181755 | A1 | 7/2009 | Gagner et al. | |
| 2009/0280888 | A1 * | 11/2009 | Durham et al. | 463/20 |
| 2009/0312095 | A1 | 12/2009 | Durham et al. | |

FOREIGN PATENT DOCUMENTS

| | | | |
|---|---|---|---|
| EP | 0 789 338 | A1 | 8/1997 |
| EP | 0 989 531 | A2 | 3/2000 |
| GB | 2 124 505 | A | 2/1984 |
| GB | 2 253 299 | A | 9/1992 |
| GB | 2 349 494 | A | 11/2000 |
| JP | 61-279272 | | 12/1986 |
| JP | 62-215854 | A | 9/1987 |
| JP | 02-019182 | | 1/1990 |
| JP | 04-109977 | | 4/1992 |
| JP | A-HO4-114676 | | 4/1992 |
| JP | A-H04-341288 | | 11/1992 |
| JP | 05-177043 | | 7/1993 |
| JP | 06-039085 | | 2/1994 |
| JP | 6-74909 | A | 3/1994 |
| JP | 07-16340 | | 1/1995 |
| JP | 60-061079 | | 4/1995 |
| JP | 07-124290 | | 5/1995 |
| JP | 07-299189 | A | 11/1995 |
| JP | 08-103541 | | 4/1996 |
| JP | 2531253 | | 1/1997 |
| JP | 9-207625 | | 8/1997 |
| JP | 10-071228 | | 3/1998 |
| JP | 10-091076 | | 4/1998 |
| JP | 10-305130 | | 11/1998 |
| JP | 10-328398 | | 11/1998 |
| JP | 11-090017 | | 4/1999 |
| JP | 11-099240 | | 4/1999 |
| JP | 11-137774 | | 5/1999 |
| JP | 11-152970 | | 6/1999 |
| JP | 11-153970 | | 6/1999 |
| JP | 11-244451 | | 9/1999 |
| JP | 2000-51314 | | 2/2000 |
| JP | 2000-65097 | | 3/2000 |
| JP | 2000-68925 | | 3/2000 |
| JP | 2000-262738 | | 9/2000 |
| JP | 2002-113150 | | 4/2002 |
| JP | 2002-195960 | A | 7/2002 |
| JP | 2002-279964 | | 9/2002 |
| JP | 2003-296733 | A | 10/2003 |
| WO | WO 99/53454 | A1 | 10/1999 |
| WO | WO 99/64997 | A1 | 12/1999 |
| WO | WO 00/32286 | A1 | 6/2000 |
| WO | WO 01/34262 | | 5/2001 |
| WO | WO 03/089080 | | 10/2003 |
| WO | WO 2006/036948 | A2 | 4/2006 |
| WO | WO 2006/039371 | A2 | 4/2006 |
| WO | WO 2006/124976 | A1 | 11/2006 |
| WO | WO 2007/005846 | A2 | 1/2007 |
| WO | WO 2007/011717 | A2 | 1/2007 |
| WO | WO 2007/030781 | A2 | 3/2007 |
| WO | WO 2007/030781 | A3 | 3/2007 |

OTHER PUBLICATIONS

"Big Games Safari" Product Sheet, IGT, 24 pages (2000).
"Cabby Cash™" Product Sheet, Anchor Gaming, 2 pages (2000).
"Congo Quest™" Product Sheet, Anchor Gaming, 2 pages (2000).
"Fishin' Buddies™" Product Sheet, Anchor Gaming, 2 pages (2000).
Legato, Frank, "The Full Monty," Strictly Slots, pp. 48-50 (Jun. 1999).
Brochure for "3RV", WMS Gaming Inc., Waukegan, IL, 2 pages, undated.
"Goooaal!" Product Sheet, Bally Gaming, Inc., 2 pages (2000).
"Great Whites" Product Sheet, VLC, Inc., 2 pages (2000).
"Jackpot Stampede Deluxe™" Product Sheet, WMS Gaming Inc., 2 pages (1997).
"Loaded Dice" Product Sheet, Konami Gaming, 2 pages (2000).
"Neptune's Pearls" Product Sheet, Unidesa Gaming, 4 pages (1998).
"Penguin Pays" Product Sheet, Aristocrat Incorporated, 2 pages (1998).
"Stroke of Luck™" Product Sheet, WMS Gaming Inc., 2 pages (1997).
"Wild Cougar" Article, Strictly Slots, p. 44 (Feb. 1999).
"Yahtzee® Brand Video Game" Product Brochure, Hasbro, Inc., 2 pages (2000).
Article for "Flip Flop", *Strictly Slots*, p. 48, Jun. 2000.
Article for "The Pink Panther", *Strictly Slots*, p. 50, Feb. 2001.
"Prism (optics)", (http://en.wikipedia.org/wiki/Prism_%28optics%29) 2 pp., Oct. 14, 2006.
"Optics", (http://en.wikipedia.org/wiki/Optics) 5 pp., Oct. 14, 2006.
"Liquid Crystal Display", (http://en.wikipedia.org/wiki/Liquid_crystal_display) 8 pp., Oct. 14, 2006.
"Light-emitting diode", (http://en.wikipedia.org/wiki/Light-emitting_diode) 13 pp., Oct. 14, 2006.
"The Other Microdisplay" Technology Report of May 11, 2006, (http://www.electronicdesign.com/Articles/Print.cfm?AD=1&ArticleID=12440) 3 pp., Oct. 14, 2006.
"Rear-Projection HDTV Microdisplays Fire Back" Technology Report of May 11, 2006, (http://www.electronicdesign.com/Articles/Print.cfm?AD=1&ArticleID=12441) .9 pp., Oct. 14, 2006.
"The Microdisplay Page . . . your guide to microdisplay development around the world", (http://tfcg.elis.ugent.be/microdis) 10 pp., Oct. 14, 2006.
Article, "Microdisplays Move Outside the Box," *Spie's OE Magazine*, Nov. 2002; 3 pgs.
International Search Report—PCT/US07/15186 dated Oct. 3, 2008 (2 pages).
International Search Report—PCT/US07/15185 dated Sep. 25, 2008 (2 pages).
International Search Report—PCT/US07/15171dated Oct. 3, 2008 (2 pages).
International Preliminary Report on Patentability for International Application No. PCT/US2008/081995, dated Nov. 7, 2009 (7 pages).
International Preliminary Report on Patentability for International Application No. PCT/JP2007/066532, dated Mar. 17, 2009 (3 pages).
International Search Report for International Application No. PCT/US2008/081995, dated Jan. 26, 2009 (1 page).
International Search Report for International Application No. PCT/JP2007/066532, dated Oct. 9, 2007 (1 page).
Written Opinion of the International Searching Authority for International Application No. PCT/US2008/081995, dated Jan. 26, 2009 (5 pages).
Written Opinion of the International Searching Authority for International Application No. PCT/JP2007/066532, dated Oct. 9, 2007 (4 pages).
European Extended Search Report, Application No. 07810069.0 (PCT/US2007/015186), dated Nov. 19, 2010, 6 pages.
European Extended Search Report, Application No. 10172635.4 , dated Oct. 27, 2010, 6 pages.

* cited by examiner

WAGERING GAME APPARATUS AND METHOD TO PROVIDE A TRUSTED GAMING ENVIRONMENT

CROSS REFERENCE TO RELATED APPLICATIONS

This application is a U.S. national stage filing of International Application No. PCT/2008/081995, filed Oct. 31, 2008 claiming priority from both U.S. Provisional Application No. 61/001,335, filed Nov. 1, 2007 which are both incorporated herein by reference in their entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines and methods for playing wagering games, and more particularly, to a gaming machine having video displays that provide images that simulate mechanical-type spinning reels.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

Video-based slot machines allow for flexibility in game design and do not require any additional hardware for implementing different games, such as bonus games. With respect to flexibility in game design, the video display of a video-based slot machine can depict complex and entertaining graphical images, animations, and play sequences that cannot be employed in mechanical slot machines. Video-based slot machines do not require any additional hardware for implementing bonus games because the bonus game may be depicted on the primary video display and executed by the same game controller used to execute the video slot game.

Video-based slot machines and mechanical slot machines generally appeal to different segments of the market. Although many players are attracted to the complex and entertaining graphical images, animations, and play sequences afforded by video-based slot machines, many players are still drawn to mechanical slot machines because they are simplistic machines that often only pay on a single pay line and only require a pull of a handle to initiate a spin of the reels. Part of the reason that these players avoid video-based slot machines is that the simulated reels on the video-based machines are visually indistinct from one another, if not sterile in appearance.

SUMMARY OF THE INVENTION

The present invention relates to technology, techniques, instruction sets, methods and/or systems for making a gaming environment, particularly but not necessarily a 3-D gaming environment, appear more trustworthy to players. The present invention is useful, example, to ease the transition from a traditional mechanical slot machine to a video slot machine for players who trust mechanical slots, but lack confidence in or trust in video slots.

The present invention includes a method of configuring a wagering game system to provide a trusted gaming environment, comprising the act of randomly selecting at least one simulated physical imperfection from a plurality of available simulated physical imperfections to associate with at least one element of a video image output to a wagering game machine video display and associating the selected simulated physical imperfection with at least one element of the video image.

The present invention also includes a method of configuring a plurality of wagering game machines to provide a trusted gaming environment which includes, in another aspect, the act of randomly selecting a simulated physical imperfection from a plurality of available simulated physical imperfections to associate with at least one element of a video image output to a wagering game machine video display. The method also includes the acts of associating the selected simulated physical imperfection with a video image output to a selected one of the plurality of wagering game machines and repeating the acts of randomly selecting a simulated physical imperfection and associating the selected simulated physical imperfection with a video image for each of the plurality of wagering game machines.

In yet another aspect of the present concepts, a method of configuring a wagering game machine to provide a trusted gaming environment includes the acts of selecting an audio signature corresponding to a predetermined simulated physical imperfection of a simulated moving element from a plurality of available audio signatures and associating the selected audio signature with video image data comprising video images for a simulated moving element.

In a further aspect of the present concepts, a gaming system is configured to provide a trusted gaming environment for wagering games and includes a controller configured to conduct a wagering game and to render simulated mechanical reels within the wagering game in 3-D, the simulated mechanical reels displaying images indicating a randomly selected outcome of the wagering game. The gaming system also includes at least one memory bearing executable instructions configured to render, on a video display of a wagering game machine, simulated mechanical reels within the wagering game and to randomly introduce at least one randomly selected simulated physical imperfection to the simulated mechanical reels.

Still another aspect of the present concepts includes a gaming system configured to provide a trusted gaming environment for wagering games for a plurality of linked wagering game machines. In this gaming system are provided a plurality of wagering game machines, each of the plurality of wagering game machines comprising a housing, a video display, and an audio system. The gaming system also includes at least one controller configured to conduct a wagering game on each of the plurality of wagering game machines and to render a simulated mechanical element in 3-D within wagering games conducted on the plurality of wagering game machines, the simulated mechanical elements displaying images indicating a randomly selected outcome of the wagering game. The gaming system also includes a memory bearing an executable instruction set configured, for each of the plurality of wagering game machines to display a background screen and to render the simulated mechanical element within the wagering game in 3-D and to introduce at least one randomly selected simulated physical imperfection to the simulated mechanical element of each of the plurality of wagering game machines.

The above summary of the present invention is not intended to represent each embodiment or every aspect of the present invention. The detailed description and Figures will describe many of the embodiments and aspects of the present invention.

BRIEF DESCRIPTION OF THE DRAWINGS

The foregoing and other advantages of the invention will become apparent upon reading the following detailed description and upon reference to the drawings.

DESCRIPTION OF ILLUSTRATIVE EMBODIMENTS

Figure 1A:
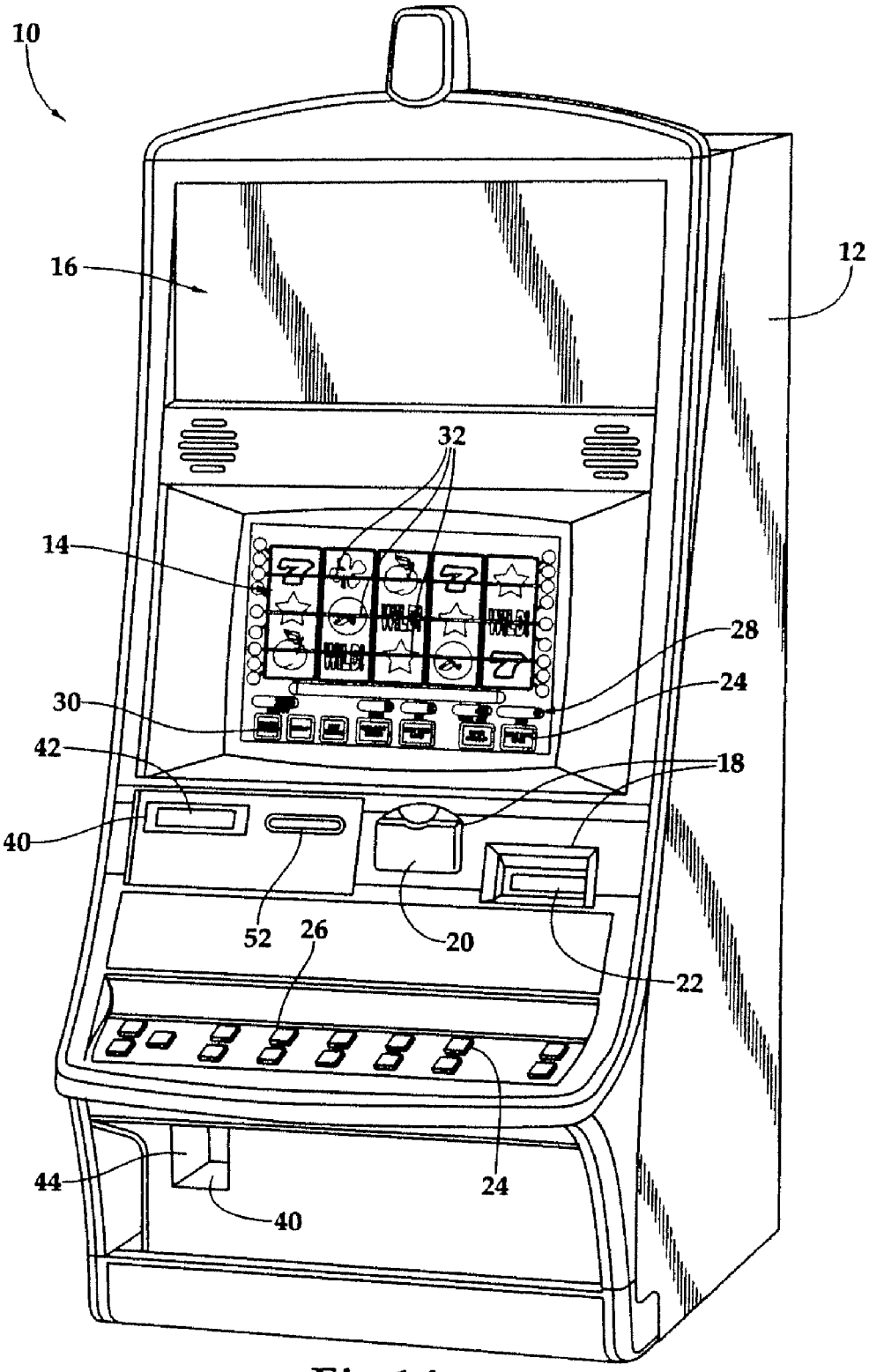
FIG. 1A is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
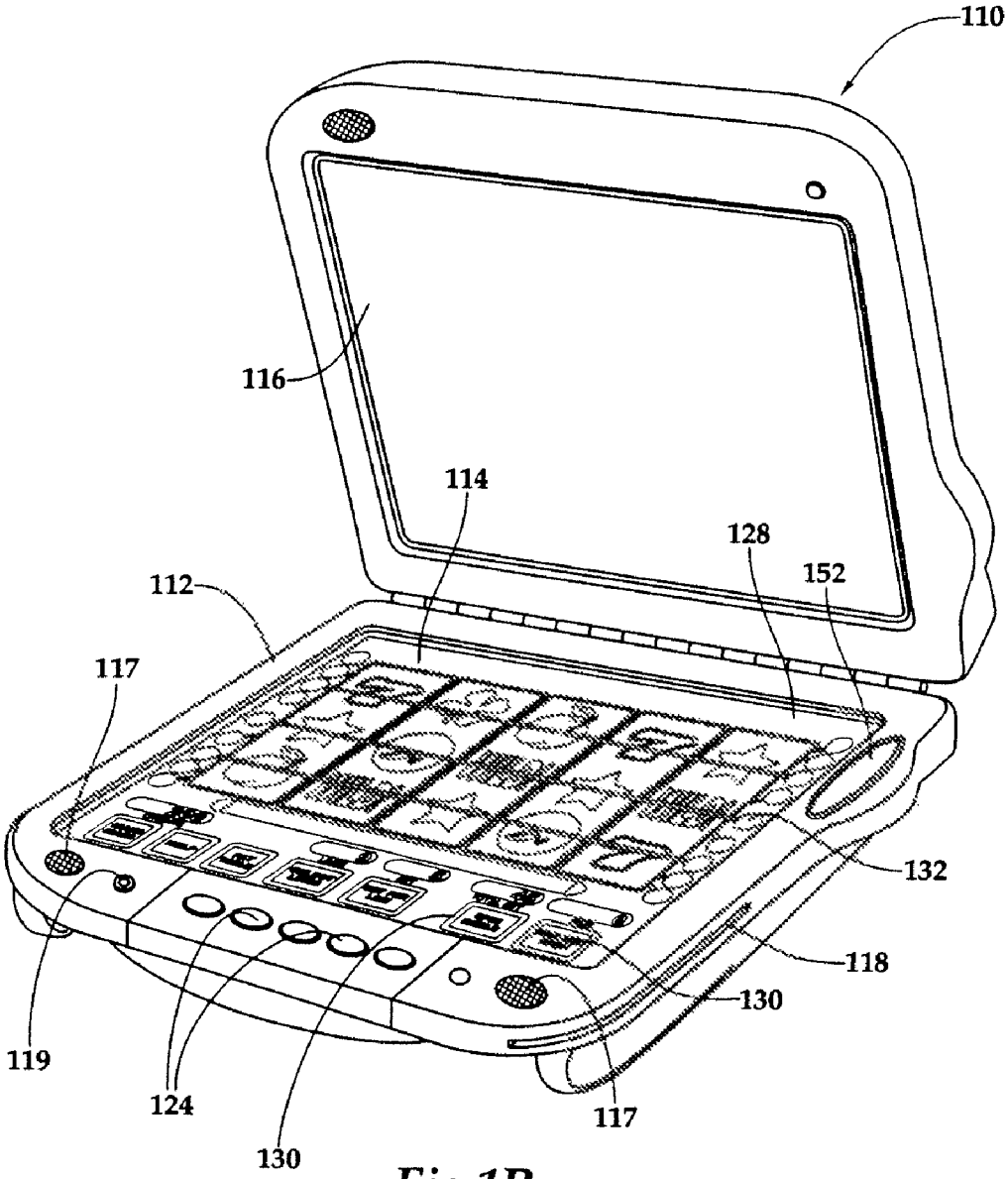
FIG. 1B is a perspective view of a handheld gaming machine embodying the present invention.

Depicted in FIG. 1*b* is a handheld or mobile gaming machine 110. Like the free standing gaming machine 10, the handheld gaming machine 110 is preferably an electronic gaming machine configured to play a video casino game such as, but not limited to, blackjack, slots, keno, poker, blackjack, and roulette. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen 128 mounted to a primary display 114 and/or secondary display 116. In one aspect, the touch screen 128 is matched to a display screen having one or more selectable touch keys 130 selectable by a user's touching of the associated area of the screen using a finger or a tool, such as a stylus pointer. A player enables a desired function either by touching the touch screen 128 at an appropriate touch key 130 or by pressing an appropriate push button 126 on the button panel. The touch keys 130 may be used to implement the same functions as push buttons 126. Alternatively, the push buttons may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably takes the form of a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 18 or an assignment of credits stored on the handheld gaming machine via the touch screen keys 130, player input device 124, or buttons 126) on the handheld gaming machine 110. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1*b*, comprises a biometric sensing device.

Figure 2:
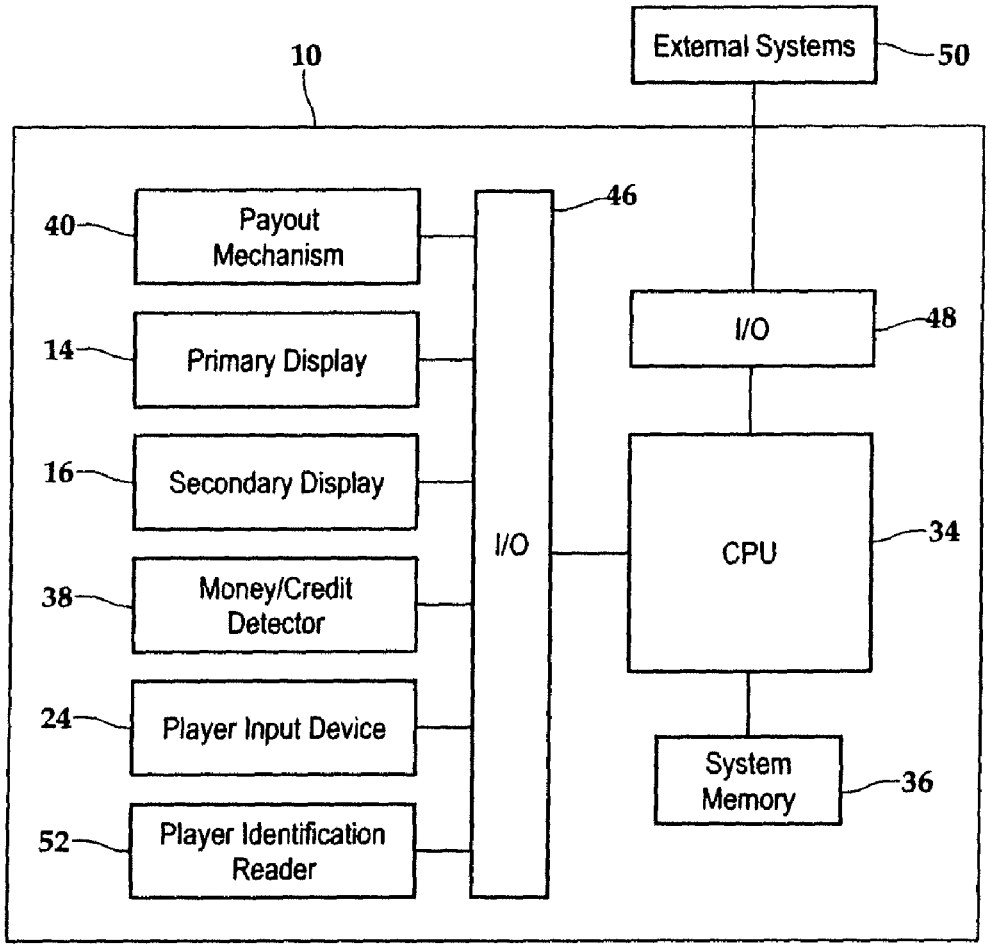
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1*a*, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10,110 may communicate with external systems 50 (in a wired or wireless manner) such that each machine operates as a "thin client," having relatively less functionality, a "thick client," having relatively more functionality, or through any range of functionality therebetween (e.g., a "rich client"). As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display (s) of the machine. In an alternative "rich client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) (e.g., 14, 16) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

As noted above, the present invention relates to technology, techniques, instruction sets, methods and/or systems for making a gaming environment such as, but not limited to, a 3-D gaming environment, appear more trustworthy to players. Mechanical systems are believed by some players to be more trustworthy or familiar. Such players may even deem particular machines as lucky over substantially identical machines because the lucky machine may have a particular physical characteristic that slightly distinguishes one machine from another and to which the player develops an affinity. The uniformity or virtual perfection imposed by conventional video-based gaming machines is, therefore, potentially off-putting to some, such as those who seek to or desire a connection with a particular machine. The present invention therefore, seeks to differentiate machines from one another in a generally subtle manner, although such differentiation need not be subtle. In this manner, among banks of wagering game machines, each machine may be at least slightly differentiated from every other machine so as to avoid a sterile "sameness" among the bank.

Figure 3A:
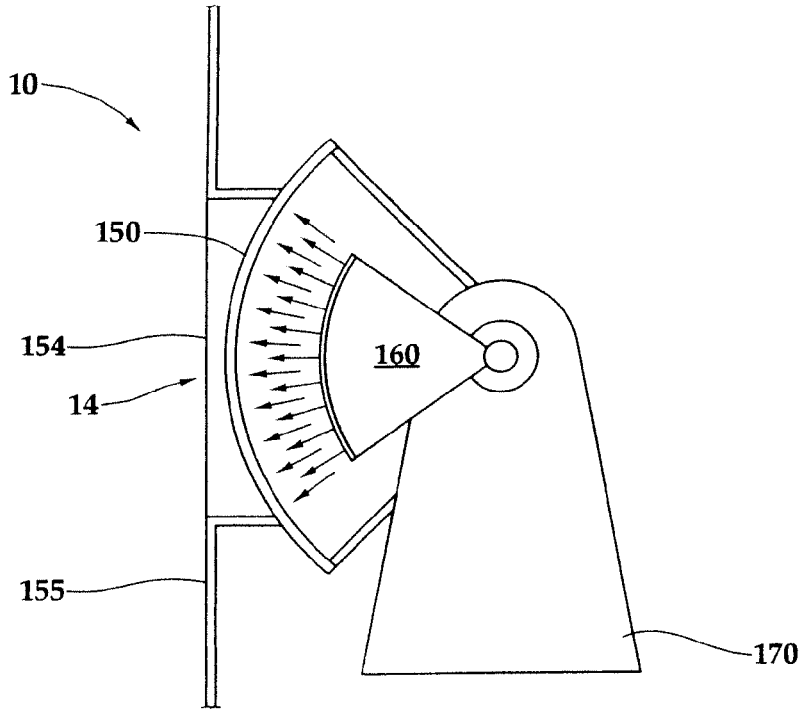
FIGS. 3A-3B are views of a display region of the wagering game machine utilizable in combination with aspects of the present concepts.
Figure 3B:
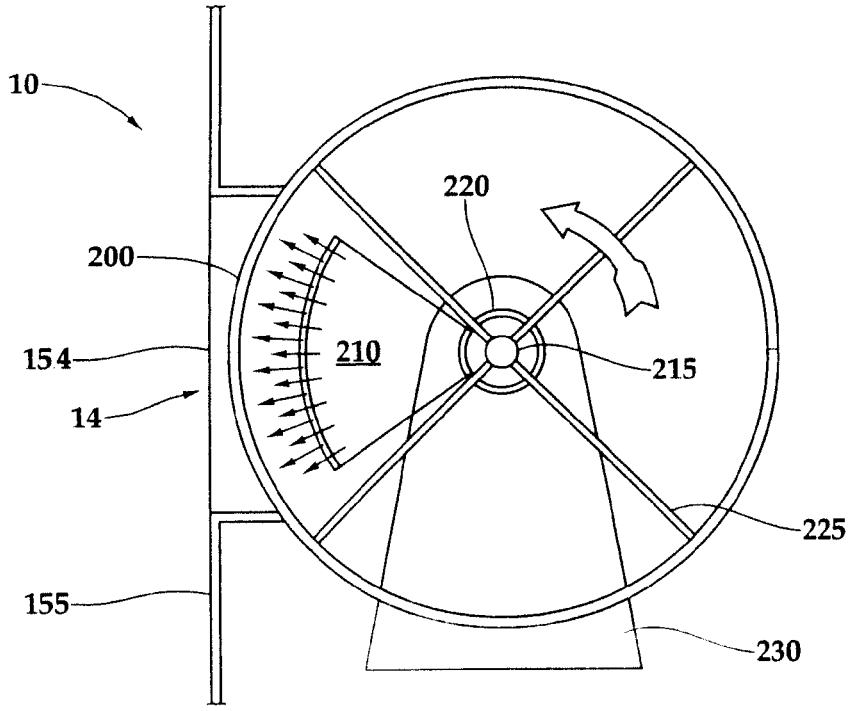

The present concepts are applicable to any video display device, arrangement, or system and may include, but is not limited to, a CRT or a flat or curved panel video display (e.g., LCD, plasma, etc.). For example, the present concepts could be implemented on the wagering game machine 10 primary display 14 or secondary display 16 or on handheld gaming machine 110 primary display 114 or secondary display 116, shown in FIGS. 1A-1B. FIGS. 3A-3B show various non-limiting configurations of wagering game displays or display systems that may be advantageously used, in accord with the concepts disclosed herein, in combination with a transparent layer that is curved to approximate the physical shape of conventional mechanical reels, so as to blur the boundary between conventional mechanical reels and the video image system that replaces such mechanical reels.

FIG. 3A shows an example wherein a primary display 14 of a gaming machine 10 includes a transparent layer 150 located within an outer window 154 attached to the housing 155 of the gaming machine. The transparent layer 150 has a radius of curvature that is similar to the radius of curvature of a mechanical reel used within a mechanical-reel style of gaming machine 10 (e.g., about four inches to about seven inches). The transparent layer 150 may comprise, for example, a transparent layer, semi-transparent, or one or more layers of any material(s) adapted to transmit or block any desired wavelength(s) and/or phases(s) of incident light. FIG. 3A also shows a video display device 160, which may comprise a projection device configured to transmit or project images onto the transparent layer 150. The video display device 160 can be, for example, an LCD projection device or a DLP projection device that outputs images to the transparent layer 150. The images produced by the video display device 160 are dynamic images that move in a manner that is similar to the movement of symbols on a mechanical reel. Accordingly, the images include a plurality of symbols used for indicating the randomly selected outcome of the wagering game. From the player's perspective, these images appear to be symbols rotating on a mechanical reel having a radius of curvature equivalent to the radius of curvature of the transparent layer 150. The video display device 160 and transparent layer 150 can be mounted to one common structure 170 located within the housing 155 or can be mounted directly to the housing 155.

FIG. 3B illustrates another embodiment in which the primary display 14 includes a transparent layer 200 that moves within the housing 155 adjacent to the window 154. The radius of curvature of the transparent layer 200 is similar to the radius of curvature of a mechanical reel within a typical slot machine. The video display device 210 is located within a transparent layer 200 and projects moving images onto the moving transparent layer 200. In one embodiment, the velocity of the moving images produced by the video display device 210 generally corresponds to the velocity of the movement of the transparent layer 200. Thus, the image projected onto the transparent layer 200 is synchronized with the movement of the transparent layer 200. In this situation, the gaming machine 10 would typically include a device coupled to the drum or cage rotating the transparent layer, such as an encoder, that can be used to measure the angular position and, thus, the angular velocity of the transparent layer 200 so that the movement of the images can be synchronized with the movement of the transparent layer. The transparent layer 200 is mounted in a manner similar to a mechanical reel, such as by using a central axis 215 and support struts 225 leading from the central axis 215 to the transparent layer 200.

The embodiments shown in FIGS. 3A-3B are described in more detail in U.S. patent application Ser. No. 11/847,560, titled "Wagering Game With Simulated Mechanical Reels," to Timothy J. Durham et al., which is assigned to the assignee of the present application and which is incorporated herein by reference in its entirety. PCT Application Serial Nos. PCT/US2007/015171, PCT/US2007/015185, and PCT/US2007/015186, each filed on Jun. 29, 2007 and each being titled "Wagering Game with Simulated Mechanical Reels," are also assigned to the assignee of the present application and are also incorporated herein by reference in its entirety.

Figure 4:
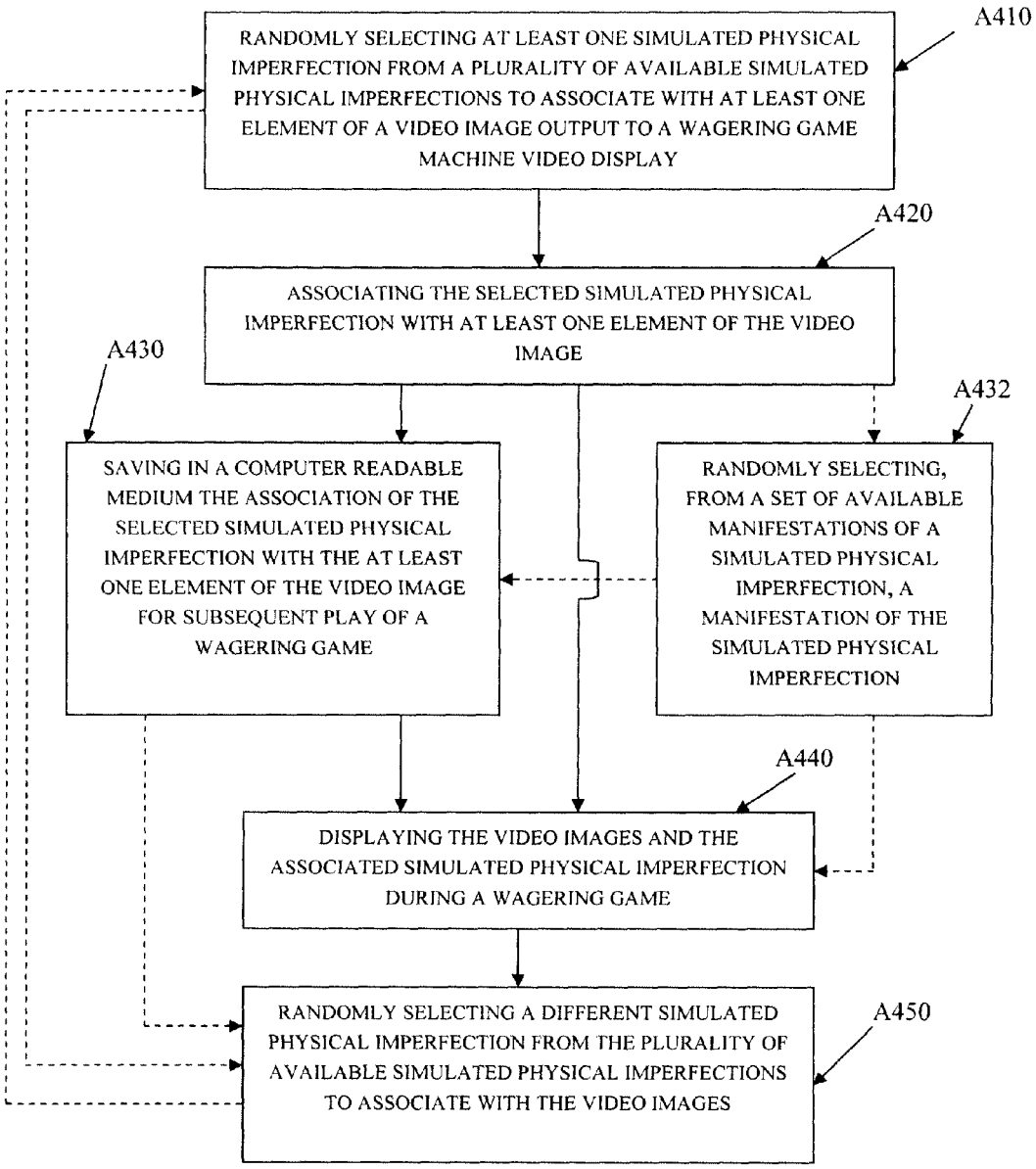
FIG. 4 shows a flowchart including acts in accord with one aspect of the present concepts.

As one exemplary aspect of the present concepts, shown in FIG. 4, a method of configuring a wagering game system to provide a trusted gaming environment includes the act A410 of randomly selecting at least one simulated physical imperfection from a plurality of available simulated physical imperfections to associate with at least one element of a video image output to a wagering game machine (e.g., 10) video display (e.g., 14). The video image is defined herein as a carrier wave or signal bearing data relating to a video output of the wagering game machine including, but not limited to video, image, and/or audio data and/or video, image, and/or audio data instructions. The method of configuring a wagering game system to provide a trusted gaming environment includes also includes the act A420 of associating the selected simulated physical imperfection with at least one element of the video image.

The simulated physical imperfections may include any simulated physical imperfection of the simulated moving or movable element (e.g., mechanical reel(s), mechanical wheel (s), moving object on display, etc.) and/or of a stationary element (e.g., background screen). Non-limiting examples include, for the example of a simulated physical imperfection of a moving element, a faded symbol, a misprinted symbol, discoloration (e.g., stain, dirt, dust, etc.), condensation, or an appearance of physical degradation, such as corrosion, abrasion, cuts, chips, gouges, scratches, peeling, delamination, or wear of the moving element. A simulated physical imperfection could also include differences in the surface textures or reflectivity of portions of a moving element or as between adjacent moving elements. Additional examples of a simulated physical imperfection of a moving element include a perceptible "wobble" in the movement of the moving element, above average spin duration or below average spin duration for the moving element (e.g., as compared to the remaining reels on that wagering game machine or on reels of similar machines), or above or below average dampening of the movement of the moving element (e.g., less or more bouncing or oscillating of the simulated reel when it stops). Still additional examples of a simulated physical imperfection of a moving element include dim-back lighting of the moving element, mis-positioned lighting of the moving element, or differing lighting intensities of different portions of the moving element, which would provide a perception or burned out lights, malfunctioning lights, or the like. Yet other examples of a simulated physical imperfection of a moving element include foreign object intrusion, such as a simulated dead bug on the moving element or adjacent thereto, such as on the transparent layer, or a simulated live bug moving on or relative to the moving element.

Likewise, in accord with the present concepts, the simulated physical imperfections need not be limited to moving elements and the present concepts specifically include simulated physical imperfections related to stationary elements. Stationary elements include, but are not limited to, a background screen, a stationary element on a background screen, a pop-up window, or an informational window. The simulated physical imperfection for such stationary element(s) include, but are not limited to those noted above with respect to moving or movable elements and also include imperfections particularly associated with a background video image such as, but not limited to, screen burn in, screen misalignment, screen color, screen sharpness, screen balance, screen brightness, and distortion (e.g., associated with a simulated magnetic interference).

In still other aspects, the simulated physical imperfections may be themed to correspond, at least in part, to a theme of a wagering game to which the simulated physical imperfections is associated. In other words, the theme of the game may influence the population of available simulated physical imperfections. A western-themed game may, for example, include more dust, the appearance of scored paper, cigarette burns, oil stains, hay, or the like. A space-themed game may include, for example, powered mineral matter, unidentifiable goo, or even floating objects, with a potential for greater distortion (e.g., magnetic) effects.

The simulated physical imperfection need not be limited to an imperfection that is visible to a player. For example, the simulated physical imperfection may comprise a sound appearing to be related to an underlying physical imperfection. Thus, the simulated physical imperfection may comprise a squeaking noise (e.g., a constant noise, an intermittent noise of a substantially fixed frequency, an intermittent noise of an indeterminate frequency), a rattling noise, a hum, a hiss, or a noise typically made, or that might be expected to be made, by a defective or malfunctioning mechanical or electrical component. Accordingly, the simulated physical imperfection may comprise an audio signature corresponding to a predetermined simulated physical imperfection of an element of a wagering game machine such as, but not limited to, a simulated moving element. This audio signature may then be related to a particular wagering gaming machine as described herein. In particular, as shown in FIG. 4, the act A410 of randomly selecting at least one simulated physical imperfection from a plurality of available simulated physical imperfections to associate with at least one element of a video image output to a wagering game machine (e.g., 10) video display (e.g., 14) may include the embedding of such an audio signature in an audio track of a video image.

The method shown in FIG. 4 may optionally include the act A430 of saving in a computer readable medium the association of the selected simulated physical imperfection with the at least one element of the video image for subsequent play of a wagering game. Computer-readable medium, as used herein, refers to any medium that participates in providing instructions to a processor for execution and program product or instructions refers to such a computer-readable medium bearing processor-executable instructions. Computer-readable mediums include, but are not limited to, non-volatile media or volatile media (e.g., hard discs, magnetic tape, CD-ROM, DVD, RAM, PROM, EPROM, FLASH-EPROM, memory chips, dynamic memory, or any other medium from which a computer can read) or transmission media (e.g., coaxial cables, copper wire, fiber optics, bus, acoustic waves, light waves, RF, etc.). Thus, the association of the selected simulated physical imperfection with an element of a video image may be saved for subsequent play of a wagering game.

As shown in FIG. 4, the association of the above-noted randomly selected simulated physical imperfection with at least one element of the video image permits the concurrent (e.g., via rendering on the fly) or subsequent displaying of the video images and the associated simulated physical imperfection during a wagering game in act A440.

Optionally, the available simulated physical imperfections may comprise different degrees of severity. In one aspect, a single simulated physical imperfection may be available for selection, but may represent a range of severity and/or manifestations of the simulated physical imperfection. For example, for a simulated physical imperfection of a simulated stain on a simulated mechanical reel, numerous variants may be randomly selectable, each variant having a distinguishing shape, color, location, and/or texture. As another example, a simulated physical imperfection in the spin characteristics of a simulated mechanical reel, such as the spin speed, spin duration, reel dampening, eccentricity or wobble, may comprise different severity levels or degrees (e.g., spin duration in seconds of x−0.5, . . . x−0.1, . . . x−0.02, x−0.01, x+0.01, x+0.02, . . . x+0.1, . . . x+0.5, etc., where x is a baseline spin duration, and any time increment or value relative thereto may be used). Thus, even where only a single simulated physical imperfection is available for selection, such simulated physical imperfection may yet present a wide range of available manifestations from which a random selection may be had.

Obviously, where a plurality of different types of simulated physical imperfections are available for selection, the better is the ability to distinguish a particular wagering game machine among a population of like wagering game machines. Thus, in accord with at least some aspects of the present concepts, the method of configuring a wagering game system to provide a trusted gaming environment includes randomly selecting a simulated physical imperfection, or more than one simulated physical imperfection, from a set of available simulated physical imperfections that may include different simulated physical imperfections, and/or a single simulated physical imperfection having different selectable manifestations (e.g., severity, appearance, size, location, characteristics, etc.) and/or different simulated physical imperfections, one or more of which may have different selectable manifestations. FIG. 4 shows, for example, act A432 of randomly selecting, from a set of available manifestations of a simulated physical imperfection, a particular manifestation (e.g., severity, appearance, size, location, characteristics, etc.) of the simulated physical imperfection.

As further shown in FIG. 4, yet another optional aspect of the present concepts may be represented, in part, by act A450 which comprises, further to acts A410 and A420, the act of randomly selecting a different simulated physical imperfection from the plurality of available simulated physical imperfections to associate with the video images. This random selection of a different simulated physical imperfection from the plurality of available simulated physical imperfections to associate with the video images may occur subsequent to the act A430 of saving of the association of the selected simulated physical imperfection with the associated element of the video image and/or the act A440 of displaying of the video images and the associated simulated physical imperfection during a wagering game. Alternatively, act A450 could occur after or concurrent with act A410 so that a plurality of simulated physical imperfections are substantially simultaneously determined and associated with one or more elements of the video image in act A420. Such plural simulated physical imperfections and associations with the video images may be saved in a computer readable medium for subsequent play of a wagering game, as in act A430, or may be provided in an on-the-fly rending.

Any of the acts A410 through A450, singly or in combination, may be performed in accord with a schedule, an occurrence of a predetermined event, a manual input, randomly, a lapse of time, a state of an adjacent wagering game machine, an introduction of a player identifier, and/or a counter related to a duration of wagering game play for the wagering game machine. To provide one illustrative example, at start up of the wagering game machine, a plurality of simulated physical imperfections (A-n, where n represents any integer) having severity levels of 1-10. The processor selects a random number of simulated physical imperfections or a designated number thereof. In the present example, it will be assumed that the processor selected five simulated physical imperfections having severity levels of 2, 8, 5, 7, and 3, respectively (i.e., $A_2$, $B_8$, $E_5$, $T_7$, $V_3$). The processor may optionally weight one or more of the parameters (e.g., $(0.9)(A_2)$, $B_8$, $E_5$, $(1.2)(T_7)$, $V_3$).

Moreover, certain simulated physical imperfections, such as opposites which would tend to cancel each other out or similar traits which might tend to be additive or attract to much attention, may be designated as being mutually exclusive or as being subject to a mandatory weighting to diminish potentially detrimental additive effects. For example, it may not be desirable to have a processor's random selection to cause the simulated physical imperfections of both moderate to severe dust on the reel and moderate to severe dust on the transparent layer or window, so one of these simulated physical imperfections may be either discarded in favor of another random selection or attenuated or weighted to a lesser severity. As another example, it may not be desirable to have a processor's random selection to cause the simulated physical imperfections of both moderate to severe dust on the reel and moderate to severe bad lighting of the simulated mechanical object (e.g., simulated mechanical reel), so one of these simulated physical imperfections may be either discarded in favor of another random selection or attenuated. Thus, in accord with at least some aspects of the present concepts, some selections, random or otherwise, might be dependent upon other selections and therefore may be subject to a dependency condition (e.g., an AND/OR table, weighting table, etc.).

Returning to the timing of the or triggering of any of the acts A410 through A450, singly or in combination, in accord with a schedule or a lapse of time, for example, the manifestation(s) (e.g., severity, appearance, size, location, characteristics, etc.) of the simulated physical imperfection(s) may get worse over time in accord with a specified schedule or a randomized schedule. Thus, for example, a simulated physical imperfection $A_n$, where n is an integer representation of the severity level of the simulated physical imperfection, could progress from $A_1$ on day 1 to $A_{10}$ on day 10, at which time, for example, the process could decrement the severity level downwardly, the processor could select another simulated physical imperfection in place of that simulated physical imperfection, or the processor could eliminate that simulated physical imperfection, or take some other action.

As noted above, the processor could be configured to set simulated physical imperfection(s) and/or associated manifestation(s) at one wagering game machine to the same state as an adjacent wagering game machine, with or without variation. In this manner, the differences between adjacent machine made be made more subtle to casual observation. In another example, the processor could be configured to adjust a setting of a simulated physical imperfection(s) or particular manifestation(s) of simulated physical imperfections at a first wagering game machine to the same state as a second wagering game machine, whether local or remotely located, because such second wagering game machine has a higher than average level of coin in. In another example, the processor could be configured to adjust a setting of a simulated physical imperfection, or particular manifestations of simulated physical imperfection, at a wagering game machine when the wagering game machine has a lower than average level of coin in (e.g., as compared to other local wagering game machine having differing simulated physical imperfection(s) or particular manifestations of simulated physical imperfections). The adjustments noted above could comprise, for example, elimination of one or more of the simulated physical imperfections and/or associated manifestations in effect at the wagering game machine in favor of other randomly determined simulated physical imperfections and/or associated manifestations.

Thus, the wagering game machines and/or gaming systems employing the present concepts are optionally adapted to dynamically manage the simulated physical imperfections or simulated physical imperfections having particular manifestations in accord with performance metrics. If particular simulated physical imperfections or simulated physical imperfections having particular manifestations are determined, for example, to generate greater coin-in than wagering game machines having different simulated physical imperfections or particular manifestations thereof, the other wagering game machines may be automatically changed to reflect such other, more successful simulated physical imperfections or particular manifestations thereof.

In other aspects, the simulated physical imperfections or simulated physical imperfections having particular manifestations may be saved by a player or may be associated with a player, such as through a player's club card, player ID, player biometric characteristic, or the like. Thus, where a player develops an affinity for a particular combination of simulated physical imperfections or particular manifestations of one or more simulated physical imperfections, the player may voluntarily save such settings. However, these associations need not be known to the player. The wagering game establishment may determine, for example, that a player historically wagers more with a particular simulated physical imperfection, simulated physical imperfections, or particular manifestations of one or more simulated physical imperfections (e.g., a gimpy reel), and may subsequently alter the setting of a wagering game machine at which the player has logged into to reflect the setting that the player appears to favor.

In yet other aspects, the automatic altering of simulated physical imperfections or particular manifestations of simulated physical imperfections may be tied to a schedule, as noted above. Although the schedule for altering of simulated physical imperfections or particular manifestations of simulated physical imperfections may be applied uniformly for a particular wagering game machine or group of wagering game machines, each of the simulated physical imperfections or particular manifestations of simulated physical imperfections for a particular wagering game machine or group of wagering game machines may be tied to a separate schedule, so that the individual alterations on a wagering game machine or between similarly situated wagering game machines are less noticeable. In still other examples, such alterations may be related to a counter that tracks a metric of wagering game play, such as a duration of wagering game play or an amount of coin in for the wagering game machine or for an associated group of wagering game machines.

Figure 5:
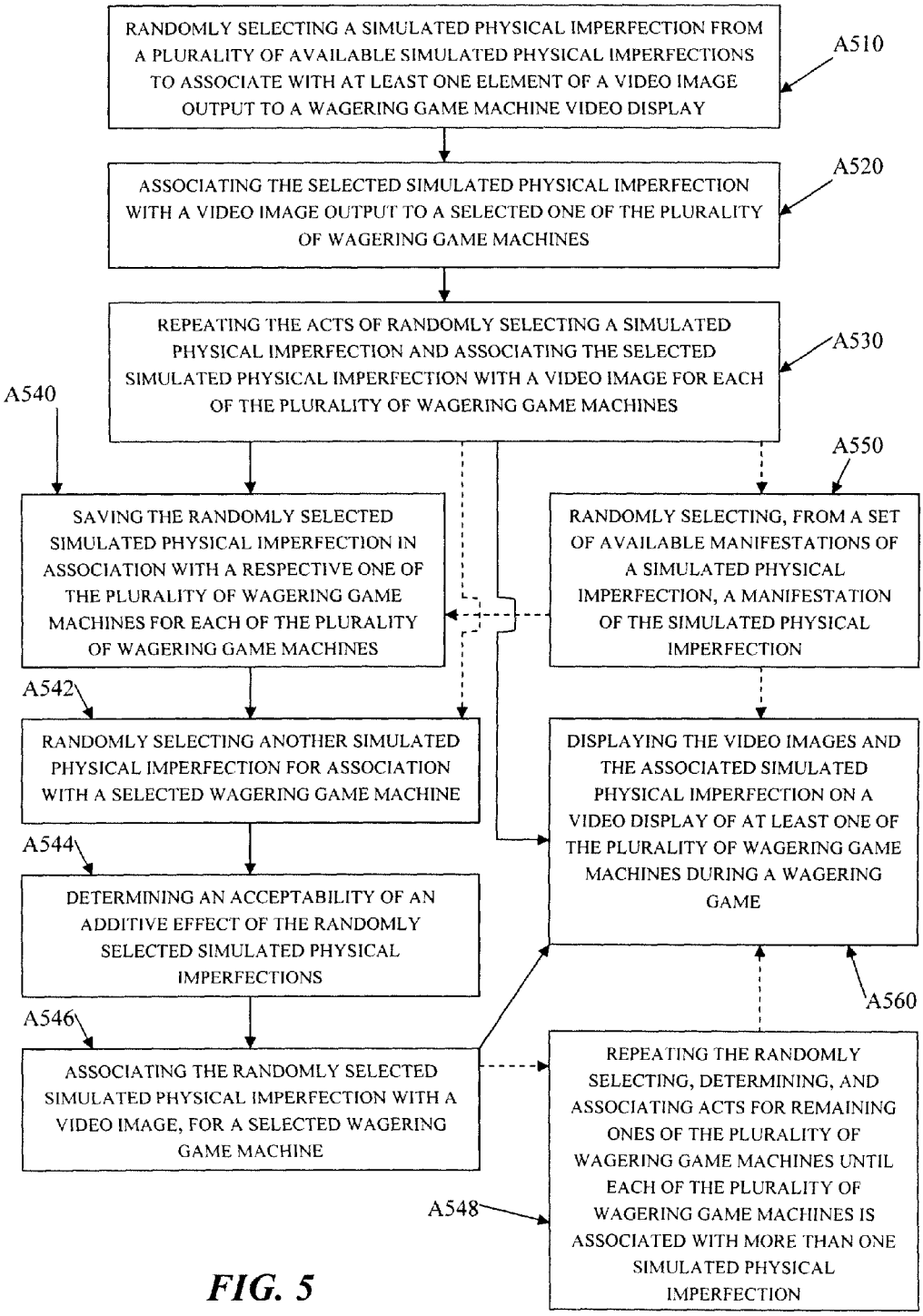
FIG. 5 shows a flowchart including acts in accord with another aspect of the present concepts.

In another aspect of the present concepts, shown in FIG. 5, a method of configuring a plurality of wagering game machines to provide a trusted gaming environment comprises the acts of randomly selecting a simulated physical imperfection from a plurality of available simulated physical imperfections to associate with at least one element of a video image output to a wagering game machine video display (A510), such as primary display 14 of wagering game machine 10, and associating the selected simulated physical imperfection with a video image output to a selected one of the wagering game machines (A520), as described above. This method includes, in act A530, repeating the acts of randomly selecting a simulated physical imperfection and associating the selected simulated physical imperfection with a video image for each of the wagering game machines. Thus, this method specifically encompasses the application of the trusted gaming environment to a population of wagering game machines.

As with the previously described method, this method of configuring a wagering game machine 10, 110 to provide a trusted gaming environment may further comprise the act A560 of displaying the video image and the associated selected simulated physical imperfection on a video display (e.g., 14) of one or more of the wagering game machines during a wagering game. Likewise, as described above, the method may include the act A540 of saving the randomly selected simulated physical imperfection in association with a respective one of the plurality of wagering game machines for each of the plurality of wagering game machines and/or the act A550 of randomly selecting, from a set of available manifestations of a simulated physical imperfection, a manifestation of the simulated physical imperfection.

In another aspect of the method described in FIG. 5, the method may further comprise the acts of randomly selecting another simulated physical imperfection for association with a selected wagering game machine (act A542), and determining an acceptability of an additive effect of the randomly selected simulated physical imperfections (act A544), associating the randomly selected simulated physical imperfection with a video image, for a selected wagering game machine (act A546). These acts of randomly selecting, determining, and associating (A542, A544, A546) may then be repeated for remaining ones of the plurality of wagering game machines until each of the plurality of wagering game machines is associated with more than one simulated physical imperfection in act A548. The act A544 of determining of an acceptability of an additive effect of the randomly selected simulated physical imperfections is intended to ensure that the combined effects of the randomly selected simulated physical imperfections or particular manifestations thereof are not overly distracting to the player or detrimental to the wagering game play experience.

Figure 6:
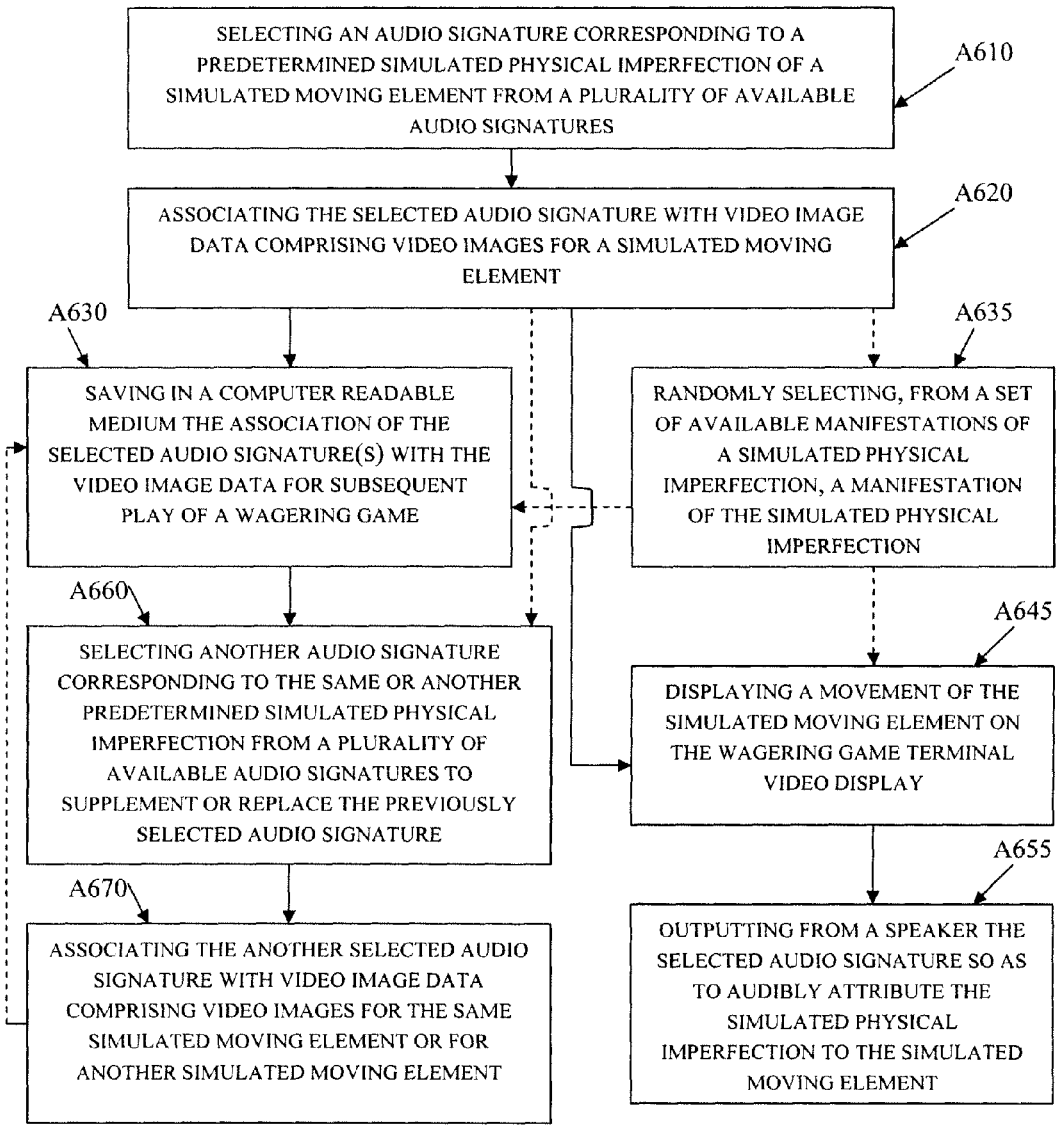
FIG. 6 shows a flowchart including acts in accord with yet another aspect of the present concepts.

Still another method of configuring a wagering game machine 10, 110 to provide a trusted gaming environment, shown in FIG. 6, includes the acts of selecting an audio signature corresponding to a predetermined simulated physical imperfection of a simulated moving element from a plurality of available audio signatures (act A610), associating the selected audio signature with video image data comprising video images for a simulated moving element (act A620). The method may also include saving in a computer readable medium the association of the selected audio signature with the video image data for subsequent play of a wagering game (act A630). The simulated moving element may comprise, for example, one or more simulated mechanical object(s), simulated mechanical reel(s), or simulated mechanical wheel(s) bearing indicia relating to the wagering game. The act of selecting, in at least some aspects, comprises random selection of an audio signature, from a plurality of available audio signatures, corresponding to a predetermined simulated physical imperfection of a simulated moving element.

The method of configuring a wagering game machine to provide a trusted gaming environment according to the example of FIG. 6 may further comprise the act A645 of displaying a movement of the simulated moving element on the wagering game terminal video display and the act A655 of outputting from a speaker, such as speaker 117 of handheld gaming machine 110, the selected audio signature so as to audibly attribute the simulated physical imperfection to the simulated moving element. Thus, for example, a squeaking noise may be associated with a simulated mechanical reel that exhibits a slight wobble or with a simulated mechanical reel that exhibits some corrosion. Optionally, as with the visually-based simulated physical imperfections, the plurality of available audio signatures may represent different auditory manifestations of a simulated physical imperfection, such as noise of a substantially fixed frequency, but with different magnitudes, or a noise with a base component (e.g., frequency, cycle, amplitude, etc.).

The method in FIG. 6 may further include the acts of selecting another audio signature corresponding to the same or another predetermined simulated physical imperfection from a plurality of available audio signatures to supplement or replace the previously selected audio signature (A660) and associating the another selected audio signature with video image data comprising video images for the same simulated moving element or for another simulated moving element (A670). This association may then be saved, in act A630, in a computer readable medium.

As with the methods described in relation to the examples of FIGS. 4-5, the acts depicted by way of example in FIG. 6 may be performed in accord with a schedule, following an occurrence of a predetermined event, a manual input, randomly, a lapse of time, a state of an adjacent wagering game machine, an introduction of a player identifier, and/or a counter related to a duration of wagering game play for the wagering game machine.

In yet another aspect of the present concepts, a gaming system is configured to provide a trusted gaming environment for wagering games and comprises a controller 34 configured to conduct a wagering game and to render simulated mechanical reels within the wagering game in 3-D, the simulated mechanical reels displaying images indicating a randomly selected outcome of the wagering game. The gaming system also includes one or more memory devices bearing executable instructions configured to render, on a video display of a wagering game machine, simulated mechanical reels within the wagering game and to randomly introduce at least one predetermined simulated physical imperfection to the simulated mechanical reels. As described above, the predetermined simulated physical imperfection(s) is/are randomly selected from one of a plurality of different available simulated physical imperfections or a plurality of different manifestations (e.g., severity, appearance, size, location, characteristics, etc.) of or more simulated physical imperfections. Advantageously, the executable instructions are further configured to cause the controller 34 to track a duration of any simulated physical imperfection(s) to permit, for example, time-based modification of the simulated physical imperfection(s), such as to increase a degree of severity of a simulated physical imperfection over time.

A gaming system in accord with yet another aspect of the present concepts is configured to provide a trusted gaming environment for wagering games for a plurality of linked wagering game machines 10*a-n*, 110*a-n*, where n is any integer. This gaming system comprises a plurality of wagering game machines, such as wagering game machine 10 shown in FIG. 1A, each of the plurality of wagering game machines 10*a-n* comprising a housing, a video display (e.g., 14), and an audio system. At least one controller 34, whether resident locally in one of the wagering game machines 10*a-n* or remotely, is configured to conduct a wagering game on each of the plurality of wagering game machines and to render one or more simulated mechanical movable mechanical elements (e.g., mechanical reels, etc.) in 3-D within wagering games (e.g., base wagering games, bonus games, secondary games, progressive games, etc.) conducted on the wagering game machines, the simulated mechanical reels displaying images indicating a randomly selected outcome of the wagering game. At least one memory, which may be local or remote and which may be distributed, bears a first executable instruction set configured, for each of the wagering game machines, to display a background screen and to render simulated movable mechanical elements (e.g., mechanical reels, etc.) within the wagering game in 3-D. The executable instruction set is also configured to introduce at least one simulated physical imperfection to one or more of the simulated movable mechanical elements for each of the wagering game machines. The simulated physical imperfection is randomly selected from an available population of simulated physical imperfections, at least one of which may optionally include a plurality of potential manifestations.

As with the previously described aspects of the present concepts, the controller 34 is optionally configured to change an assigned manifestation such as, but not limited to a severity, for any simulated physical imperfection at any of the wagering game machines in accord with a schedule, an occurrence of a predetermined event, a manual input, randomly, a lapse of time, a state of an adjacent wagering game machine, an introduction of a player identifier, and/or a counter monitoring some parameter of interest. For example, the controller 34 may be configured to track wagering inputs to each of the plurality of wagering game machines over a predetermined period of time and, responsive to the tracked wagering inputs, to change a simulated physical imperfection and/or a manifestation of the simulated physical imperfection assigned to a wagering game machine to at least substantially correspond to a combination of simulated physical imperfection and/or manifestation thereof for another of one of the wagering game machines having higher coin-in.

As noted above, it is preferred that the gaming machine 10 be configured to generate 3-D effects, and still more preferably to generate such 3-D effects in real-time with a 3-D engine (e.g., "rendering on the fly"). In one embodiment, the 3-D virtual controls may be implemented using a game design package such as RenderWare Studio 2.0 running, for example, on one or more processors (e.g., Intel or AMD chips, etc.). In at least some aspects, the gaming environment and moveable visual elements are generated in real-time using a 3-D game engine (e.g., game middleware) and/or 3-D engine (e.g., graphics engine, rendering engine) such as, but not limited to RenderWare®, developed and maintained by Criterion Software/Electronic Arts (EA), any publicly available free or open-source engines and commercial engines (e.g., Unigine, Power Render, Dagor Engine 3, etc.), or any other commercial or proprietary game engine currently existing or later developed. The concepts presented herein do not depend upon any particular application programming interface (API). The term "game engine" is used herein, for brevity, to refer to both or either of a 3-D game engine and/or a 3-D engine. The present concepts may also advantageously include a physics engine, whether separately or as part of a game engine, to realistically animate physical objects. Alternatively, sequences of or images of the simulated mechanical objects (e.g., mechanical reels) on the display 14, are pre-generated or pre-rendered in 2-D or 3-D, wholly or in part, and, rather than being generated or rendered on the fly, are displayed with the same effect. The simulated mechanical imperfections may, moreover, be separately rendered from the simulated mechanical objects and applied as, for example, a pre-generated overlay.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

For example, although the present concepts are described in relation to simulated physical imperfections, the present concepts include simulated characteristics that are not actual representations of imperfections, but are rather simply randomized differences (i.e., not "imperfections") that are utilized to differentiate wagering game machines from one another and to temper the sameness of video-based wagering game machines. Further, the randomized differences need not occur during or in association with the wagering games themselves and may occur in an "attract" mode. For example, in a western-themed game, one wagering game machine may be configured to display, in the "attract" mode, a randomized characteristic of oil dripping down the display, whereas another wagering game machine may be configured to display a bullet hole in the display, and another wagering game machine may be configured to display a shell casing at the bottom of the display. These configurations may optionally be retained upon activation of the wagering game machine by a player until such time as the controller alters the configuration of the wagering game machine, as noted above, to randomly change the simulated physical characteristics.

What is claimed is:

1. A method of configuring a wagering game system to provide a trusted gaming environment, comprising:

randomly selecting, for a wagering game machine for the wagering game system, at least one simulated physical imperfection from a plurality of available simulated physical imperfections to associate with at least one element of a video image output to a video display device of the wagering game machine; and associating the selected simulated physical imperfection with at least one element of the video image;

randomly selecting another simulated physical imperfection for association with a selected wagering game machine;

determining an acceptability of an additive effect of the randomly selected simulated physical imperfections; and associating the randomly selected simulated physical imperfection with a video image, for a selected wagering game machine.

2. The method of claim 1, further comprising:

saving in a non-transitory computer readable medium the association of the selected simulated physical imperfection with the at least one element of the video image for subsequent play of a wagering game on the wagering game machine.

3. The method of claim 1, further comprising:

displaying the video images and the associated simulated physical imperfection on the wagering game machine video display device during a wagering game.

4. The method of claim 1, wherein the video image displayed on the wagering game machine video display device comprises at least one simulated moving element selected from the group consisting of a mechanical reel bearing indicia relating to the wagering game and a mechanical wheel bearing indicia relating to the wagering game.

5. The method of claim 1, wherein the plurality of available simulated physical imperfections represent different degrees of a single simulated physical imperfection.

6. The method of claim 4, wherein the simulated physical imperfection displayed on the wagering game machine video display device is associated with the at least one moving element and comprises at least one characteristic selected from the group consisting of a faded symbol on the moving element, corrosion on the moving element, a ragged edge of the moving element, a wobble in the movement of the moving element, above average spin duration for the moving element, below average spin duration for the moving element, dim-back lighting of the moving element, mis-positioned lighting of the moving element, differing lighting intensities of different portions of the moving element, a paint chip on the moving element, above average dampening of the movement of the moving element, below average dampening of the movement of the moving element, a simulated dead bug on the moving element, a simulated live bug moving on the moving element, a dirty spot on the moving element, a stain on the moving element, dust on the moving element, discoloration of at least a portion of the moving element, fading of at least a portion of the moving element, a peeling of at least a portion of a layer of the moving element, a scratch on the moving element, and gouge in the moving element.

7. The method of claim 1, wherein the simulated physical imperfection displayed on the wagering game machine video display device is associated with the background video image and comprises at least one simulated physical imperfection selecting from the group consisting of screen burn in, screen misalignment, screen color, screen sharpness, screen balance, screen brightness, and screen magnetic interference.

8. The method of claim 3, the method further comprising:

randomly selecting a different simulated physical imperfection from the plurality of available simulated physical imperfections to associate with the video images subsequent to the acts of saving of the association of the selected simulated physical imperfection with the at least one element of the video image and the displaying of the video images and the associated simulated physical imperfection during a wagering game; and saving the association of the selected different simulated physical imperfection with the video images in a non-transitory computer readable medium for subsequent play of a wagering game.

9. The method of claim 8, the method further comprising:

performing the acts of randomly selecting and saving in accord with at least one of a schedule, an occurrence of a predetermined event, a manual input, randomly, a lapse of time, a state of an adjacent wagering game machine, an introduction of a player identifier, or a counter related to a duration of wagering game play for the wagering game machine.

10. The method of claim 1, wherein the plurality of available simulated physical imperfections represent different simulated physical imperfections.

11. The method of claim 1, wherein the plurality of available simulated physical imperfections represent different degrees of severity of a plurality of simulated physical imperfections.

12. A method of configuring a plurality of wagering game machines to provide a trusted gaming environment, comprising:

randomly selecting a simulated physical imperfection from a plurality of available simulated physical imperfections stored in a non-transitory computer readable storage medium to associate with at least one element of a video image output to a wagering game machine video display;

associating the selected simulated physical imperfection with a video image output to a selected one of the plurality of wagering game machines; and repeating the acts of randomly selecting a simulated physical imperfection and associating the selected simulated physical imperfection with a video image for each of the plurality of wagering game machines.

13. A method of configuring a plurality of wagering game machines to provide a trusted gaming environment according to claim 12, further comprising:

displaying the video image and the associated selected simulated physical imperfection on a video display of at least one of the plurality of wagering game machines during a wagering game.

14. A method of configuring a plurality of wagering game machines to provide a trusted gaming environment according to claim 12, further comprising:

saving in the non-transitory computer readable storage medium the randomly selected simulated physical imperfection in association with a respective one of the plurality of wagering game machines for each of the plurality of wagering game machines.

15. A method of configuring a plurality of wagering game machines to provide a trusted gaming environment according to claim 12, further comprising:

randomly selecting, from a set of available manifestations of a simulated physical imperfection, a manifestation of the simulated physical imperfection.

16. A method of configuring a plurality of wagering game machines to provide a trusted gaming environment according to claim 15, further comprising:

saving the randomly selected simulated physical imperfection and the associated manifestation in association with a respective one of the plurality of wagering game machines for each of the plurality of wagering game machines.

17. A method of configuring a plurality of wagering game machines to provide a trusted gaming environment according to claim 15, further comprising:

repeating the randomly selecting, determining, and associating acts for remaining ones of the plurality of wagering game machines until each of the plurality of wagering game machines is associated with more than one simulated physical imperfection.

18. A method of configuring a plurality of wagering game machines to provide a trusted gaming environment according to claim 17, further comprising:

repeating the randomly selecting, determining, and associating acts for remaining ones of the plurality of wagering game machines until each of the plurality of wagering game machines is associated with more than one simulated physical imperfection.

19. A method of configuring a plurality of wagering game machines to provide a trusted gaming environment according to claim 15, further comprising:

selecting, for at least one of the plurality of wagering game machines, another simulated physical imperfection from a plurality of available simulated physical imperfections to associate with at least one element of a video image output to a wagering game machine video display;

associating the selected another simulated physical imperfection with a video image output to a selected one of the plurality of wagering game machines.

20. A method of configuring a wagering game machine to provide a trusted gaming environment, comprising:

selecting a simulated physical imperfection for a simulated moving element;

selecting a severity level for the simulated physical imperfection from a plurality of available severity levels for the simulated moving element;

selecting an audio signature corresponding to the predetermined simulated physical imperfection of the simulated moving element from a plurality of available audio signatures stored in a non-transitory computer readable storage medium;

selecting a severity level of the audio signature from a plurality of available severity levels for the audio signature;

associating the audio signature with video image data output to the wagering game machine comprising video images for a simulated moving element, displaying on a wagering game terminal video display of the wagering game machine a movement of the simulated moving element on the wagering game terminal video display; and outputting from a speaker of the wagering game machine the selected audio signature so as to audibly attribute the simulated physical imperfection to the simulated moving element.

21. The method of configuring a wagering game machine to provide a trusted gaming environment according to claim 20, further comprising:

saving in the non-transitory computer readable medium the association of the selected audio signature with the video image data for subsequent play of a wagering game.

22. The method of configuring a wagering game machine to provide a trusted gaming environment according to claim 21, the method further comprising:

selecting another audio signature corresponding to the same or another predetermined simulated physical imperfection from a plurality of available audio signatures to supplement or replace the previously selected audio signature;

associating the another selected audio signature with video image data comprising video images for the same simulated moving element or for another simulated moving element; and saving in the non-transitory computer readable medium the association of the selected another audio signature with the video image data for subsequent play of a wagering game.

23. A gaming system configured to provide a trusted gaming environment for wagering games, comprising:

a controller configured to conduct a wagering game and to render simulated mechanical reels within the wagering game in 3-D, the simulated mechanical reels displaying images indicating a randomly selected outcome of the wagering game; and at least one memory bearing executable instructions configured to permit the controller to, upon execution of the executable instructions, render, on a video display of a wagering game machine, simulated 3-D mechanical reels within the wagering game and to render a plurality of randomly selected simulated physical imperfections in association with the 3-D simulated mechanical reels, and to permit the controller to determine an acceptability of an additive effect of the plurality of randomly selected simulated physical imperfections relative to an established dependency condition.

24. A gaming system configured to provide a trusted gaming environment for wagering games for a plurality of linked wagering game machines, comprising:

a plurality of wagering game machines, each of the plurality of wagering game machines comprising a housing, a video display, and an audio system;

at least one controller configured to conduct a wagering game on each of the plurality of wagering game machines and to render at least one simulated mechanical element in 3-D within wagering games conducted on the plurality of wagering game machines, the simulated mechanical element displaying images indicating a randomly selected outcome of the wagering game; and a memory bearing an executable instruction set configured, for each of the plurality of wagering game machines, upon execution by the at least one controller, to display a background screen, to render a simulated mechanical element within the wagering game in 3-D and to introduce at least one randomly determined simulated physical imperfection to the simulated mechanical element of each of the plurality of wagering game machines, wherein the controller is configured to track wagering inputs to each of the plurality of wagering game machines over a predetermined period of time and, responsive to the tracked wagering inputs, is configured to change at least one of a simulated physical imperfection or severity level for the simulated physical imperfection assigned to a wagering game machine to at least substantially correspond to a combination of simulated physical imperfection and severity level for the simulated physical imperfection of another of one of the wagering game machines having higher wagering inputs.

25. A gaming system configured to provide a trusted gaming environment for wagering games according to claim 24, wherein the controller is configured to change an assigned severity level for the simulated physical imperfection for each wagering game machine in accord with at least one of a schedule, an occurrence of a predetermined event, a manual input, randomly, a lapse of time, a state of an adjacent wagering game machine, an introduction of a player identifier, or a counter related to a duration of wagering game play.

* * * * *